US006795985B2

(12) United States Patent
Mathias

(10) Patent No.: US 6,795,985 B2
(45) Date of Patent: Sep. 28, 2004

(54) NARROW BUTTRESS SYSTEM STRUCTURE FOR SWIMMING POOLS

(75) Inventor: George M. Mathias, St. Catharines (CA)

(73) Assignee: North American Pool Company, Toronto (CA)

( * ) Notice: Subject to any disclaimer, the term of this patent is extended or adjusted under 35 U.S.C. 154(b) by 22 days.

(21) Appl. No.: 10/303,496

(22) Filed: Nov. 25, 2002

(65) Prior Publication Data

US 2003/0145373 A1 Aug. 7, 2003

(30) Foreign Application Priority Data

Nov. 26, 2001 (CA) ..... 2363809

(51) Int. Cl.[7] ..... E04H 4/00
(52) U.S. Cl. ..... 4/506; 52/169.8; 52/169.9
(58) Field of Search ..... 4/506, 488; 52/169.7, 52/169.8, 169.9; 472/92

(56) References Cited

U.S. PATENT DOCUMENTS

| | | | | | |
|---|---|---|---|---|---|
| 1,786,613 | A | * | 12/1930 | Hooper | 52/245 |
| 3,256,532 | A | | 6/1966 | Lindsey et al | 4/172 |
| 3,274,621 | A | | 9/1966 | Diemond et al. | 4/172 |
| 3,315,278 | A | | 4/1967 | Schatzki et al. | 4/172 |
| 3,409,916 | A | * | 11/1968 | Billig et al. | 52/146 |
| 3,522,614 | A | | 8/1970 | Gould | 4/172.19 |
| 3,530,512 | A | * | 9/1970 | McBride | 52/169.7 |
| 3,553,744 | A | | 1/1971 | Gillen | 4/172.19 |
| 3,789,435 | A | | 2/1974 | Heisner | 4/172.19 |
| 3,971,075 | A | * | 7/1976 | Heinbaugh et al. | 52/169.7 |
| 4,283,804 | A | | 8/1981 | Mahoney | 4/506 |
| 4,782,538 | A | | 11/1988 | Chisholm et al. | 4/506 |
| 5,277,004 | A | | 1/1994 | Frei | 52/169.7 |
| 5,398,351 | A | | 3/1995 | Watson | 4/506 |
| 5,488,745 | A | | 2/1996 | Barrera | 4/506 |
| 5,884,347 | A | | 3/1999 | Yurchision et al. | 4/506 |
| 6,378,144 | B1 | | 4/2002 | Yurchision | 4/506 |
| 6,421,846 | B1 | * | 7/2002 | Shaanan et al. | 4/506 |

* cited by examiner

*Primary Examiner*—Gregory L. Huson
*Assistant Examiner*—Huyen Le
(74) *Attorney, Agent, or Firm*—Harness, Dickey & Pierce, P.L.C.

(57) ABSTRACT

A swimming pool structure comprises a plurality of buttress post assemblies spaced about the perimeter of the pool and servicing to support the pool wall. Each of the assemblies include a horizontal foot beam with a vertically oriented buttress post connected thereto by angle brackets. Laterally located beams and plates interconnect the sides of adjacent buttress post assemblies and the inner ends of opposing foot beams from opposite sides of the pool are directed under the floor of the pool and are secured together.

8 Claims, 16 Drawing Sheets

NARROW BUTTRESS SYSTEM STRUCTURE FOR SWIMMING POOLS

FIELD OF THE INVENTION

This invention relates to swimming pool construction and in particular to a swimming pool structure utilizing a narrow buttress system to support the walls of the pool from pressure of water in the pool.

BACKGROUND OF THE INVENTION

Swimming pools of the above-ground type conventionally utilize a plurality of vertical buttresses to support the walls of the pool and these buttresses form part of an integrated side-bracing system which utilizes rigid steel buttress braces at suitable intervals about the outer periphery of the pool. These braces may be anchored into the ground but, more likely, they will be triangulated with the bottom end of the buttress brace and, in some instances, they may be attached to steel straps that run underneath the pool.

While the above-ground pools referred to above having integrated, triangulated side bracing systems are quite effective in providing a strong wall support, the outside bracing systems can be somewhat unsightly and do require additional space around the periphery of the pool for their installation. Additionally, the outside brace systems can get in the way of users of the pool and people sometimes trip over the angled side braces with the result of possible injuries.

BACKGROUND PATENTS

Numerous patent specifications are directed to above-ground swimming pool construction. Several examples of these are as follows:

U.S. Pat. No. 4,283,804 discloses an above-ground pool having structural strips extending across the pool that are bolted to the bases of the sidewall for preventing bowing of the sidewalls caused by the water weight;

U.S. Pat. No. 5,398,351 discloses an above-ground pool having a group of modular planar structural foam sections laid on the ground underneath the pool liner;

U.S. Pat. No. 4,782,538 discloses a reservoir assembly having transversely extending frame assemblies supporting opposed sidewalls that are integral with a base member that is disposed beneath the bottom wall of the reservoir;

U.S. Pat. No. 3,553,744 discloses an above-ground pool wherein each support frame is interconnected with a corresponding support frame at the opposite side of the pool by cable disposed under the pool liner;

U.S. Pat. No. 5,884,347 (Canadian application 2,231,920) discloses a support system for an above-ground pool having one or more buttresses supporting the vertical height of the sidewall;

U.S. Pat. No. 5,488,745 discloses an above-ground pool with opposing sides of base members being retained by a plurality of base straps;

U.S. Pat. No. 3,409,916 discloses an above-ground pool having strips extending under the pool and beyond each side that attach to and support the sidewalls; and Canadian Patent application 2002/0029413 discloses a swimming pool for having extension strips that engage a crossbar at the foot of each leg.

U.S. Pat. No. 3,274,621 Diemond et al illustrates a pool structure made up of a plurality of curve linear patterns in which the vertical support members located at apices between circular components extend vertically of the outer surface of the support panel and coupling means extend beneath the pool to engage vertical support members at other apices.

U.S. Pat. No. 3,522,614 Gould (corresponding Canadian Patent 839,456) discloses L-shaped supporting posts having a leg of the L extending beneath the floor of the pool with the upper ends of the legs being interconnected by top rail portions or sections.

U.S. Pat. No. 3,315,278 Schatzki et al shows a pool structure not unlike that shown in U.S. Pat. No. 3,274,621 in that the wall of the pool is of generally circular section or sections and these sections are joined at the apices by support members such as 12 in FIG. 1 and which have leg members 14 that extend beneath the floor of the pool to interconnect with a support member on the other side thereof.

U.S. Pat. No. 3,256,532 Lindsey et al shows an above-ground pool having outer support members with extension straps 25, 27 and 29 that extend below the floor of the pool to connect with support members on the opposite side of the structure. The outer, vertical support posts have upper and lower perimeter bracing beams that go around the periphery of the structure.

U.S. Pat. No. 3,789,435 Heisner illustrates horizontal connecting members interconnecting outside bracing means that rests on support plates.

U.S. Pat. No. 6,378,144 deals with support systems, the specific arrangement of the base members located beneath the pool. The system provides support for the walls using an arrangement of buttresses, cross-members, vertical beams and a plate that supports the walls against the pressure of the water in the pool.

Several of the above-described patents show the general concept of having upright support members with means extending beneath the floor of a pool to interconnect with support members on the other side of the pool. However, the form of the buttress/base assembly of the present invention is not shown in the prior art.

Specifically, the structure of the support posts, the associated base members and the splice braces that interconnect them are important improvements in the art.

The present invention addresses the shortcomings of the above-described conventional forms of above-ground pools by providing a narrow buttress wall support system which maintains the desired shape of the pool but does not have any outside triangulated buttress supports on the exterior of the pool. In accordance with the invention, all of the buttress supports are within the buttress posts and under the pool itself.

SUMMARY OF THE INVENTION

According to a broad aspect, a swimming pool structure according to the invention comprises a plurality of buttress assemblies spaced about the perimeter of the pool. These assemblies are laterally connected one to another in side-by-side relation and also linearly in that each assembly on one side of the pool is connected to an opposing assembly on the other side. Each buttress assembly includes a-foot beam which extends inwardly under the pool floor and a vertical buttress post on the outside of the pool and which is connected to the foot beam by splice angle brackets. These splice angle brackets give the buttress posts the strength to support the wall of the pool without outside, triangulated bracing. The composition of the buttress assemblies ensure their easy handling and erection in the field.

According to a further broad aspect the invention relates to a buttress support structure for a swimming pool wall comprising a plurality of buttress assemblies spaced about the periphery of the pool, said buttress assemblies being laterally connected one to another in side-by-side relation and each buttress assembly being linearly connected to another buttress assembly directly across the pool therefrom; each said buttress assembly including a (a) foot beam extending inwardly of the pool beneath the floor thereof, (b) a vertical buttress post on the outside of the pool wall and (c) brackets connecting said buttress post to said foot beam.

According to a still further broad aspect the invention relates to a composite support assembly for use in supporting the wall of a swimming pool, said assembly comprising a base member adapted to lay horizontally beneath the floor of the pool, an upright post member to be located on the outside of the pool wall, and means interconnecting the post and base members; said interconnecting means comprising a pair of spaced, generally L-shaped angle brackets having a first pair of legs secured to each base member, one on either side thereof and with their other, second pair of legs extending vertically at right angles therefrom

DESCRIPTION OF THE DRAWINGS

The invention is illustrated, by way of example, in the accompanying drawings in which.

GENERAL DESCRIPTION OF THE MAIN COMPONENTS

Figure 1:
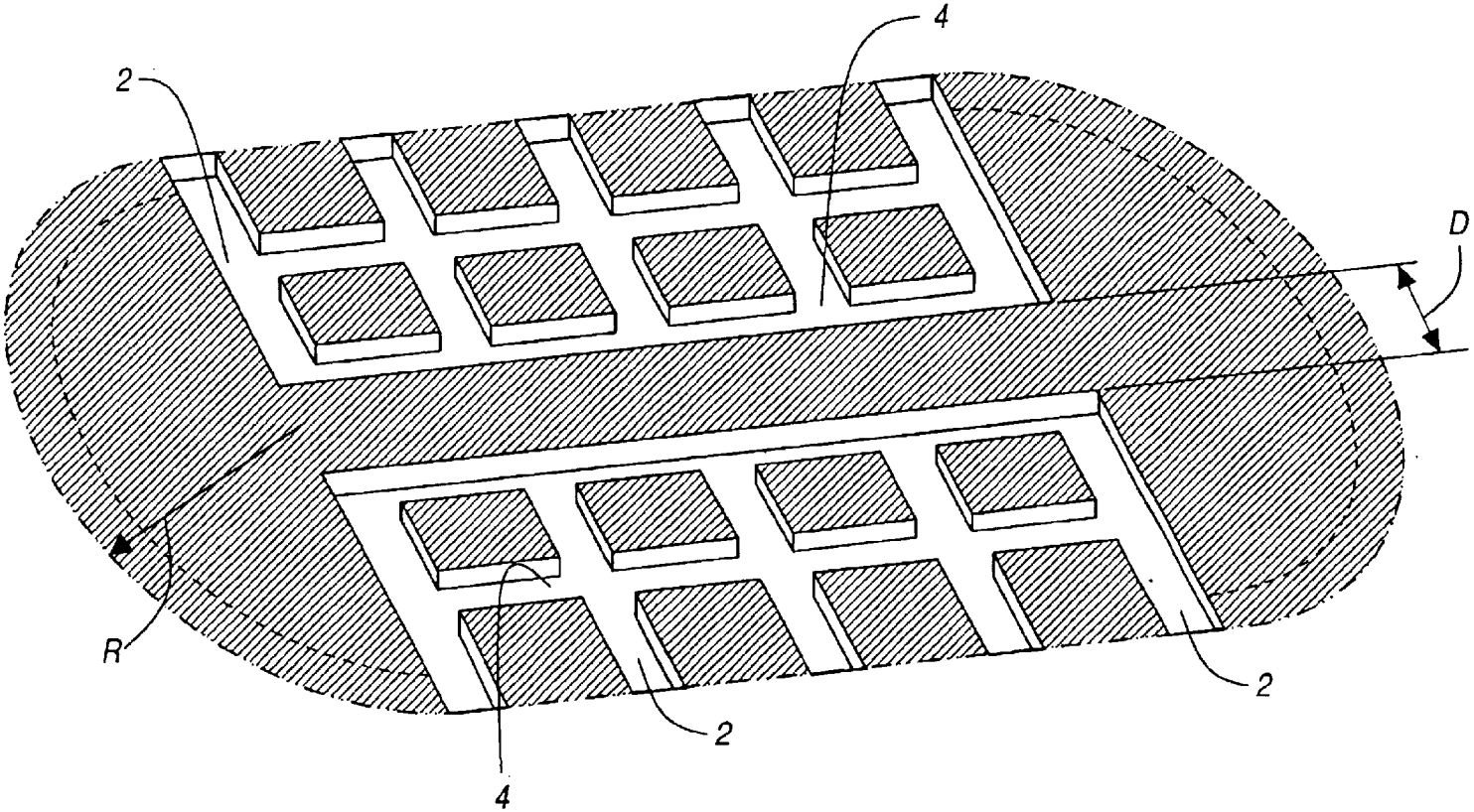
FIG. 1 illustrates an example of an excavation plan for a pool construction according to the invention.

FIG. 1 illustrates one possible pattern of excavation to be made prior to assembling the pool wall support structure. In this pattern, a series of parallel channels 2 are excavated to approximately 3¼ inches or 8 centimetres deep and they extend inwardly from the outside line of the eventual pool structure inwardly towards one another for a distance of approximately 36 inches or 91 to 100 centimetres. These excavations are joined by a series of parallel excavated channels 4 which run at right angles to and intersect excavated channels 2. These channels 2 and 4 serve to accommodate several of the main components of the pool wall support structure in accordance with the following description.

This excavation pattern is an example only as the length and width of the pool to be erected will determine a specific channel pattern to be excavated.

Figure 7:
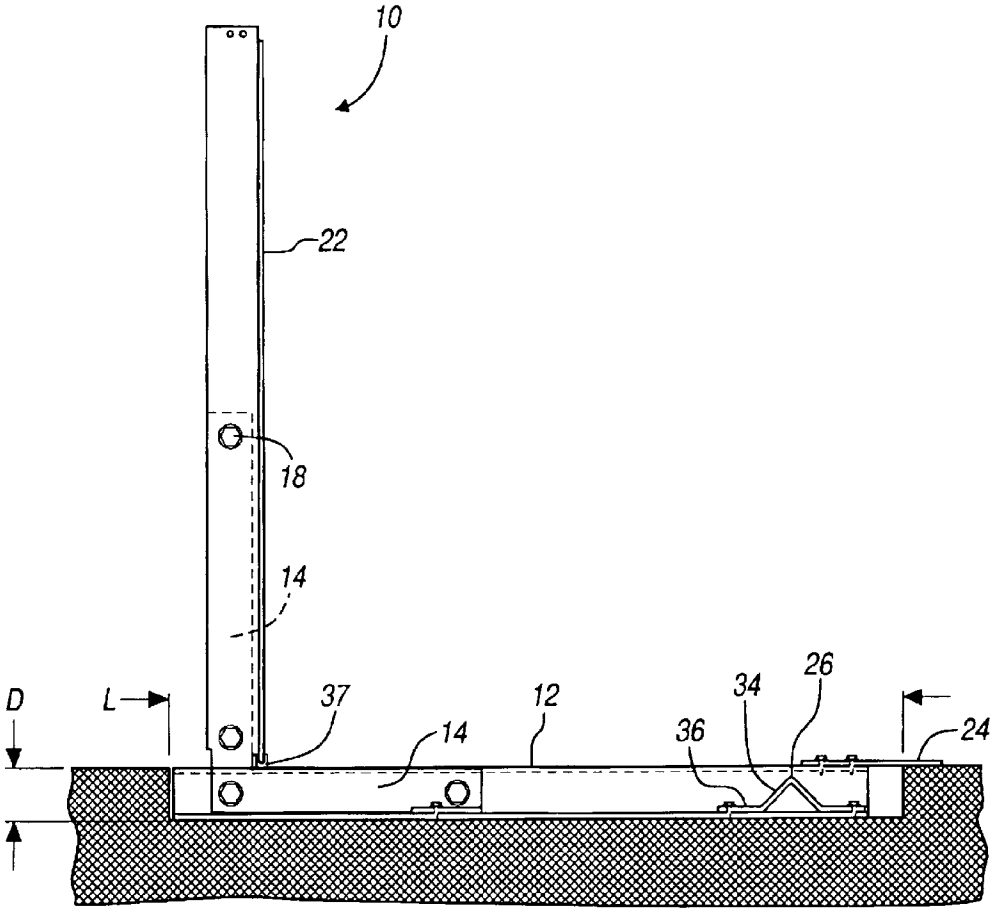
FIGS. 6 and 7 are end and elevation views similar to FIGS. 4 and 5 but show the assemblies positioned in an excavation of the type shown in FIG. 1.
Figure 6:
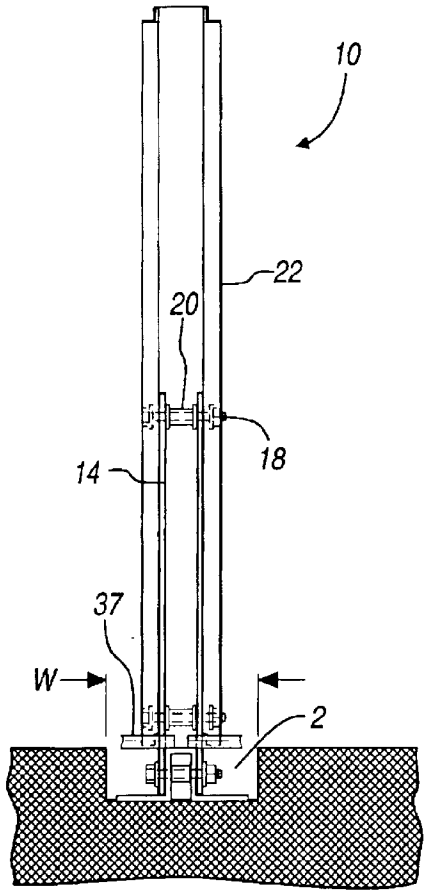
Figure 8:
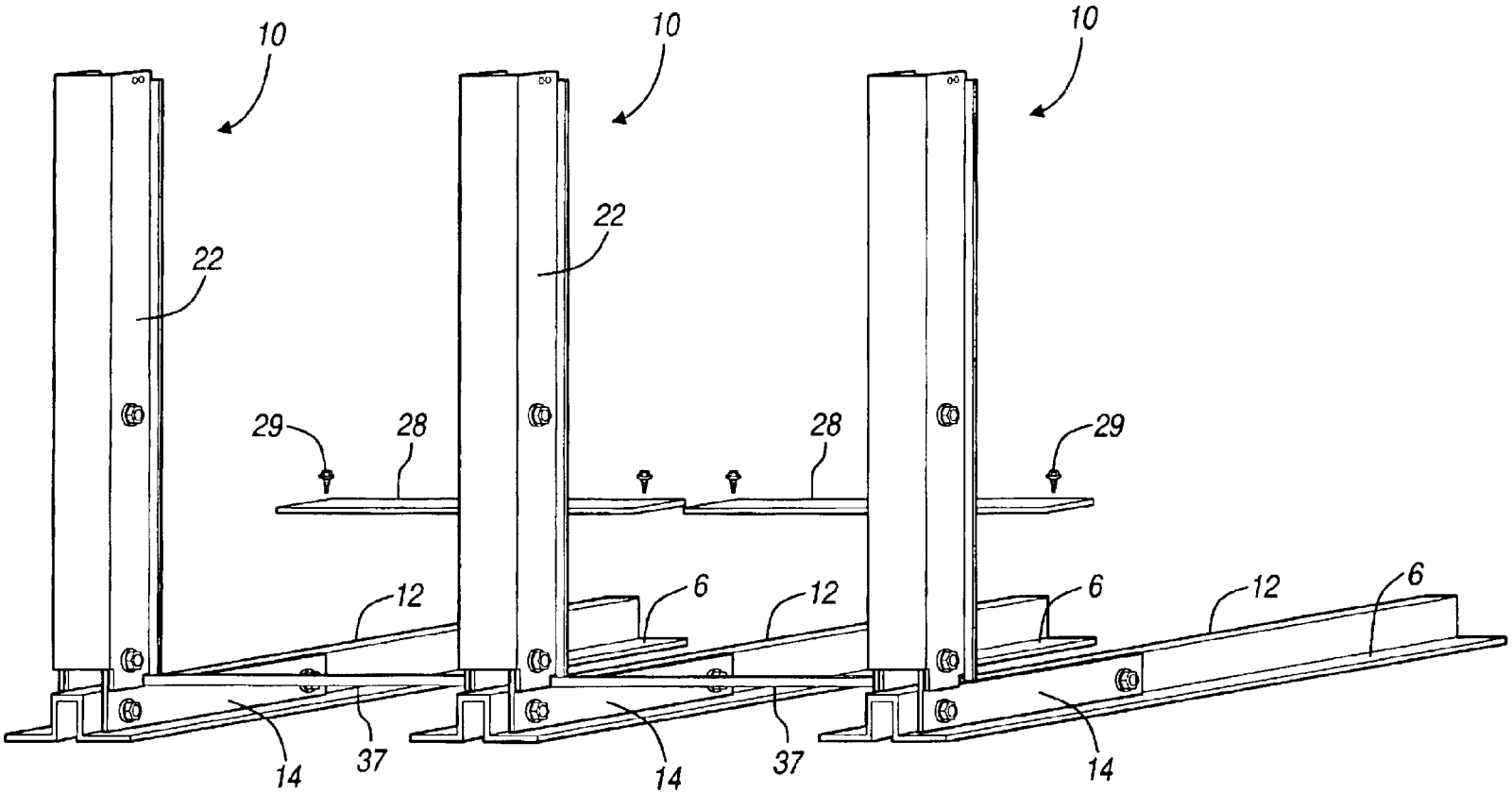
FIG. 8 is a perspective view of several buttress assemblies with support plates interconnecting them.
Figure 9:
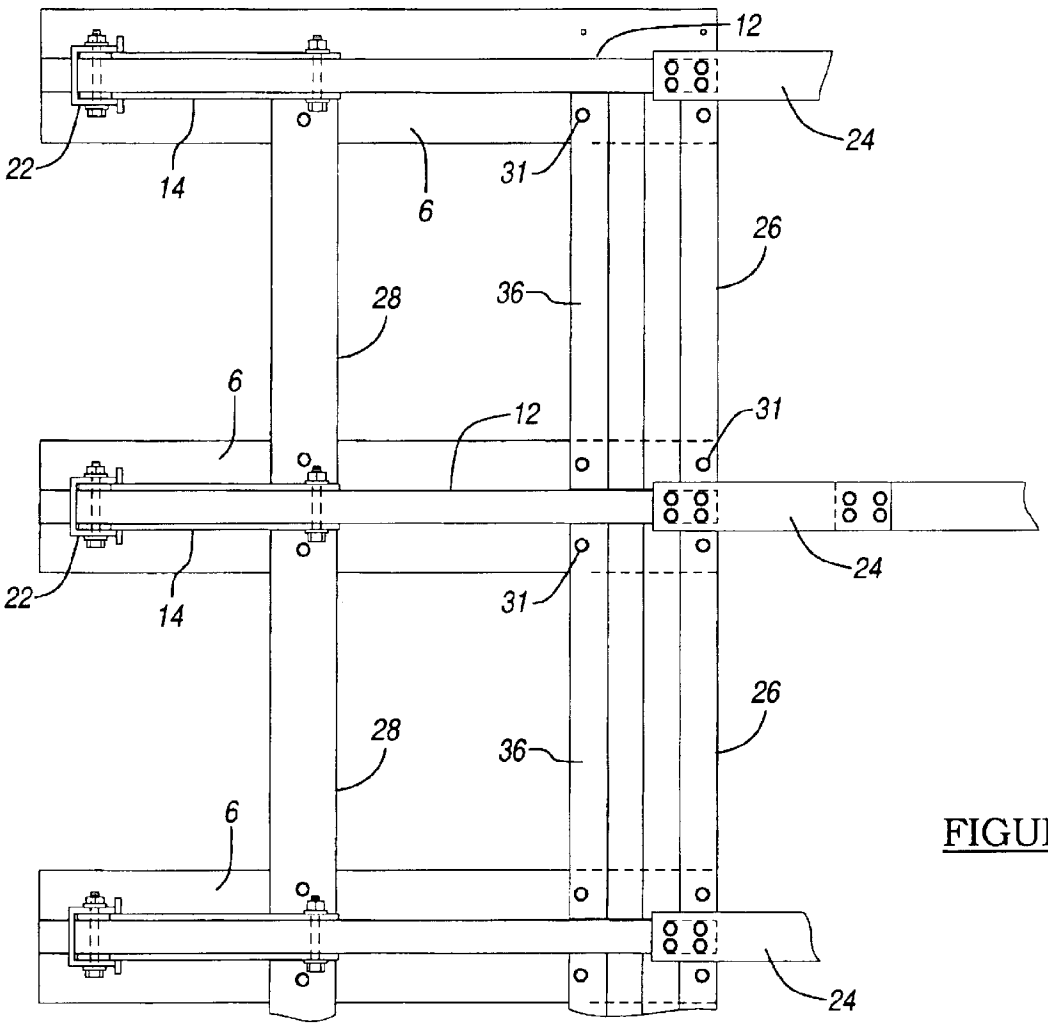
FIG. 9 is a plan view of several buttress assemblies with their interconnecting support structure.

Referring initially to FIGS. 7, 8 and 9, the buttress post assemblies are illustrated in their erected form and, in FIG. 7, being located in one of the excavations of FIG. 1. These assemblies are spaced along each side of the pool wall, being laterally connected to one another in side-by-side relation as shown in FIGS. 8 and 9 and also linearly connected as shown in FIG. 9 in that each assembly on one side of the pool is connected to an opposing assembly on the other side of the pool by means of strapping.

Figure 22:
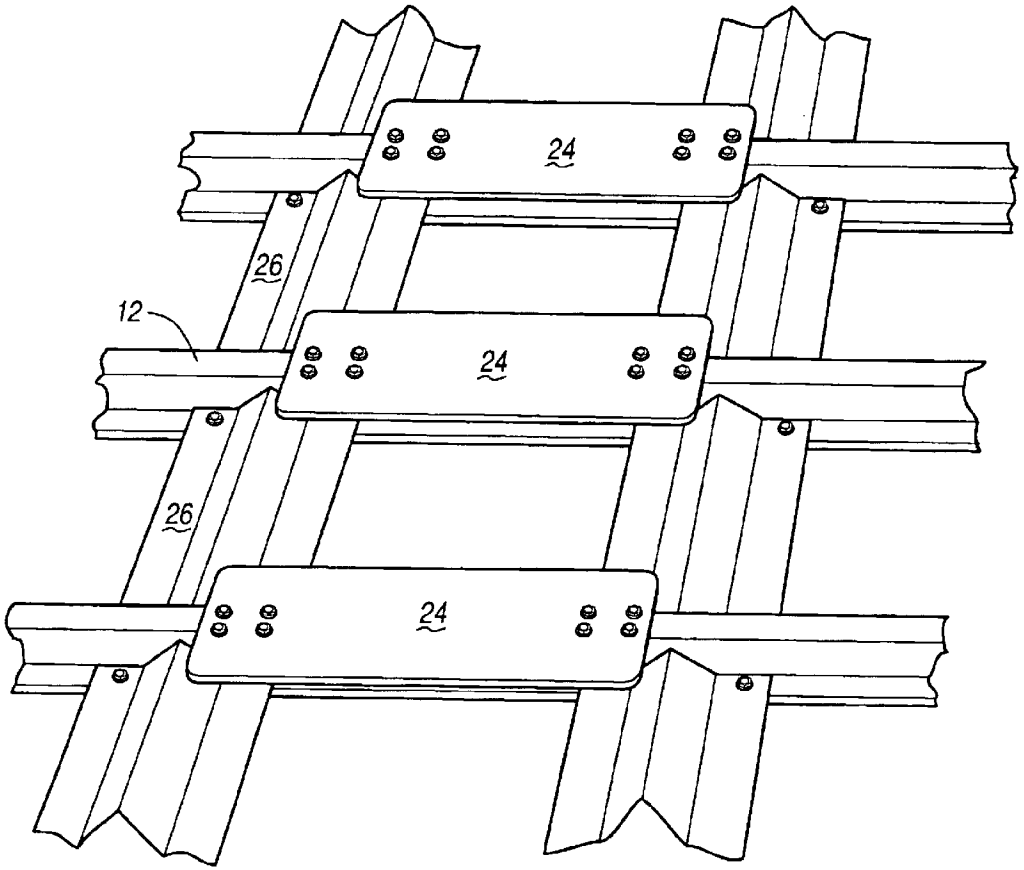
FIG. 22 is a perspective view of the central portion of an assembled pool support structure showing the interaction of the various support components.

The main components of the buttress assemblies 10 include foot beams 12 which extend inwardly of the pool floor towards the center thereof in excavated channels 2, the foot beams from one side of the pool being connected to the opposing foot beam by means of a tension strap. These tension straps 24 are manufactured in a variety of lengths to suit pools of varying width. They interconnect the inner ends of the foot beams from opposing sides of the pool as shown in FIGS. 9 and 22.

Toe beams 26 consist of an inverted "V" shaped beam which extends laterally between the inner or distal ends of the foot beams and serve to space the foot beams one from another and to provide some vertical stability to those beams at the inner ends thereof. Toe beams 26 are located in excavated channels 4 as seen in FIG. 1.

Splice angle brackets 14 consist of a series of L-shaped metal brackets which interconnect the buttress posts 22 to the associated foot beams 12. Each post assembly has a pair of splice brackets, one on either side of the foot beam and with their upper, vertical ends providing support to its associated buttress post.

Each of the buttress posts 22 has a somewhat sharp, U-shaped cross-section and is secured to and extends upwardly from the foot beam to support the wall of the pool. Each buttress post is held in its vertical position by the upper legs of the splice angle brackets.

Support plates 28 extend laterally between the foot beams and are fastened to the flanges thereof, the foot beam flanges providing a broad footing for the overall structure together with the flanges of the toe beams. Connectors 18 and 20 consist of self-tapping screws and are used for connecting the tension straps, toe beams and support plates to the foot beams. Additionally, bolts, nuts, washers and spool sleeves are used for connecting the splice angle brackets to the foot beams and to the buttress posts. The spool sleeves surround the bodies of the bolts and serve to properly space the sides of the foot beams; the sides of the buttress posts and each pair of parallel splice angle brackets from themselves.

Bottom rails 37 are open-top rails that extend between the feet of the buttress posts on the inside thereof and their ends rest on the upper surface of the foot beams.

DETAILED DESCRIPTION OF A PREFERRED EMBODIMENT

Figure 3:
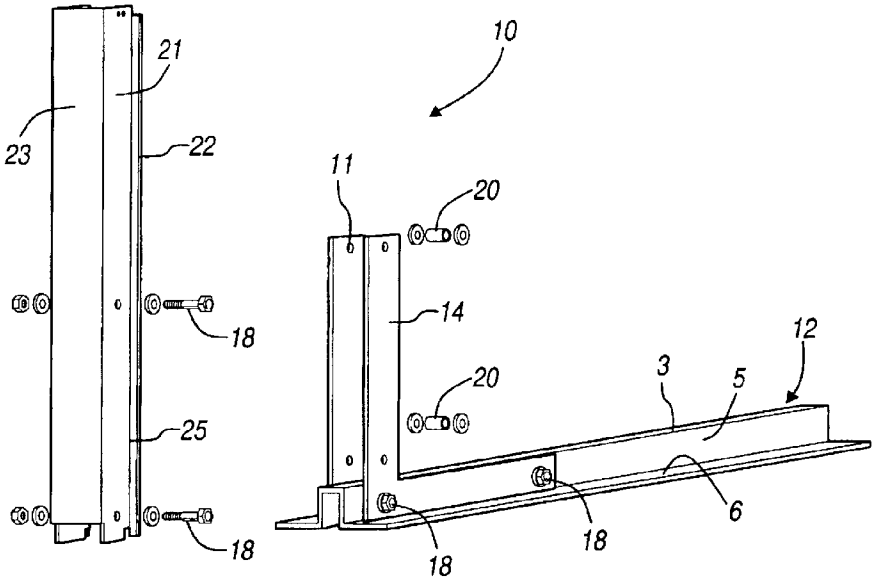
FIG. 3 is an exploded view of a buttress assembly including a buttress post.
Figure 2:
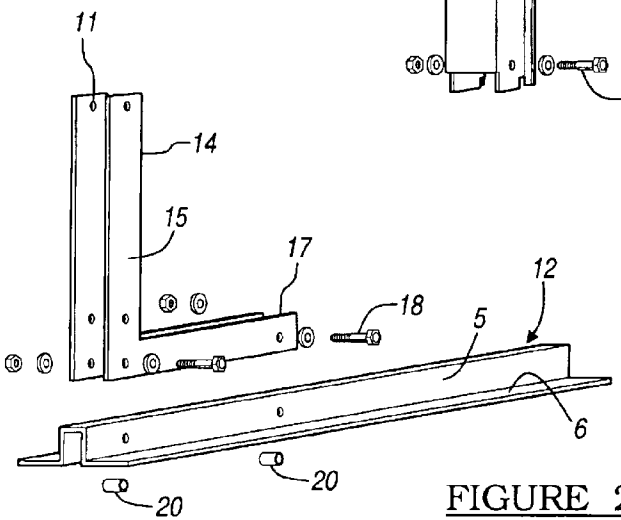
FIG. 2 is an exploded view of an incomplete buttress assembly showing a pair of splice angle brackets and a foot beam.
Figure 11:
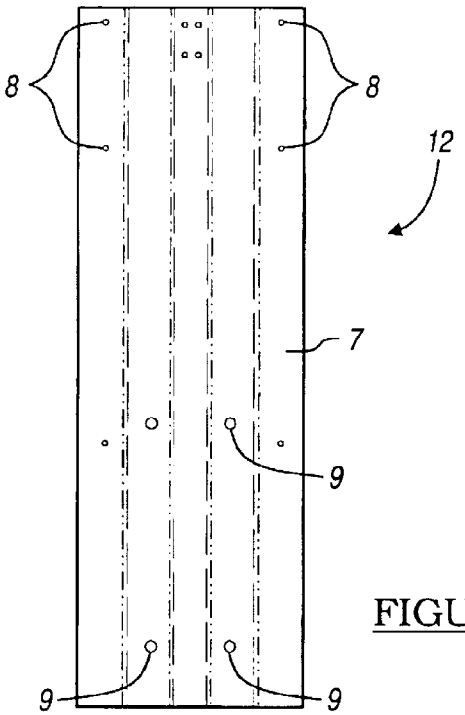
FIG. 11 is a plan view of a foot beam in blank form.
Figure 12:
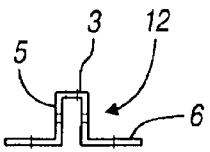
FIG. 12 is an end view of the foot beam of FIG. 11 but after it is formed.
Figure 10:
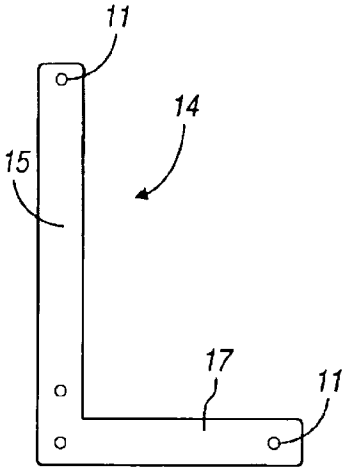
FIG. 10 is an elevation view of a splice angle bracket.

Referring to FIGS. 2 and 3, exploded views of the components that make up the buttress assemblies are illustrated generally at 10 in FIG. 3 and, as shown in FIG. 2, the base of the assembly is a foot beam 12, shown in detail in FIGS. 11 and 12 and which carries a pair of parallel, splice angle brackets 14 (FIG. 10). One of splice angle brackets is mounted on each side of the foot beam 12 and secured thereto by a bolt-nut-washer assembly 18, several of these utilizing spool spacer sleeves 20 to maintain the proper spacing between the upper and lower legs, 15, 17 respectively, of the angle brackets 14 and their associated components.

As shown in FIG. 10, the upper leg 15 of the bracket 14 is substantially longer than the lower, horizontal leg 17 and the brackets are provided with the required number of apertures 11 for reception of the bolt assemblies 18. As an example only, the material used for the production of the brackets 14 may be galvanized steel having a thickness of 0.168 inches.

FIGS. 11 and 12 show the foot beam 12 in its blank and formed layout respectively. The blank 7, formed, for example, from 12 or 14 gauged galvanized steel, is drilled at 9 to provide apertures for reception of the fastener assemblies 18 and are also drilled at locations indicated at 8 for eventual reception of fasteners connecting the toe beam 26 thereto.

When formed, as shown in FIG. 12, the foot beam has a top surface 3, side surfaces 5 and a pair of flanges 6 extending horizontally from those side surfaces. The foot beams 12 and specifically their flanges 6 eventually are located in the channels 2, excavated in the ground surface for their reception.

FIG. 2 illustrates the manner in which a pair of angle brackets 14 are positioned on the outside of the side panels 5 of the foot beam 12 and are secured thereto using the bolt-nut-washer assemblies 18 together with the spool sleeve spacers 20. High tensile bolts are used in the assemblies 18 and the spool sleeves 20 are of a suitable strength so that they will not collapse when the bolts are torqued to the required figures.

FIG. 3 illustrates the manner in which a buttress post is fastened to the outside of the pair of spaced angle brackets 14 now secured to the foot beam 12.

Figure 19:
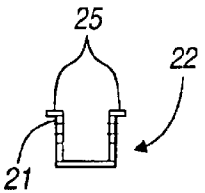
FIGS. 17, 18 and 19 are plan, side elevation and end views respectively of a buttress post.
Figure 17:
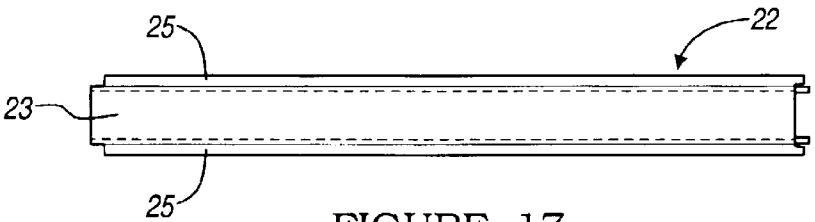
Figure 18:
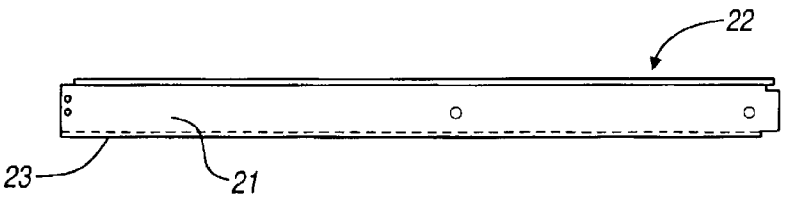
Figure 20:
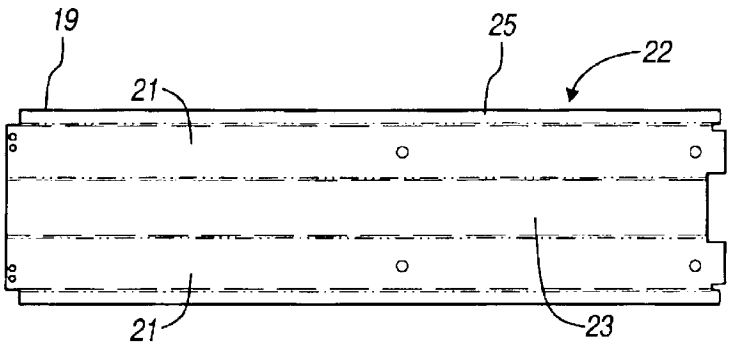
FIG. 20 is a plan view of a buttress post in blank form.
Figure 21A:
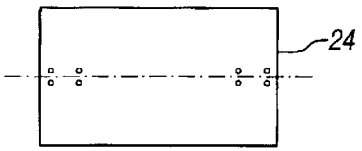
FIGS. 21A through 21E are plan views of different forms and lengths of buttress tension straps.
Figure 21B:
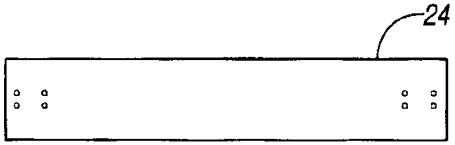
Figure 21C:
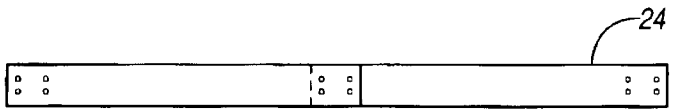
Figure 21D:
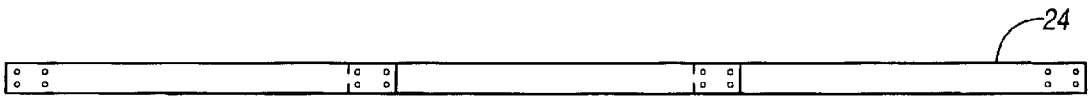
Figure 21E:
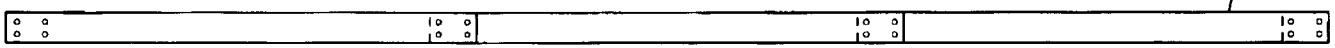

Buttress post 22 may be formed, by example, from 23 gauge steel and, as illustrated in FIGS. 17–20 inclusive, the item is originally prepared in blank form 19 and subsequently formed as in FIGS. 17–19 to have side panels 21, a front or outer panel 23 and flanges 25 extending outwardly from the side panels 21.

As shown in FIG. 3, the buttress post 22 is positioned so that its side panels 21 overlie the splice angle brackets 14 and the post 22 is then secured to those angle brackets by the combination of the bolt assemblies 18 and spool sleeve spacers 20 as illustrated.

Subsequent to their assembly as shown in FIG. 3, the buttress post assemblies 10 are then placed in the excavated channels (FIG. 1) and the remaining elements that make up the pool structure are added to them. As shown in the elevation views of FIGS. 4–7 as well as the perspective and plan views of FIGS. 8 and 9, these elements include support plates 28, toe beams 26 and tension straps 24.

Figure 16:
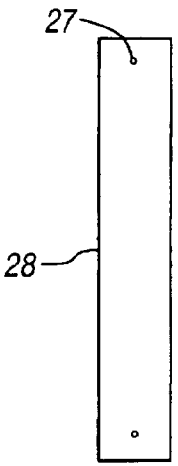
FIG. 16 is a plan view of a support plate.

FIG. 16 shows the form of one of the support plates 28 cut for example from 18 gauge steel and drilled at 27 so that, when the support plates are positioned intermediate the buttress post assembles 10 and transverse thereto as shown in FIG. 9, they are secured to the flanges 6 of the foot beams 12 by suitable fastening means such as self-tapping screws 29. It will be noted from FIG. 9 that support plates 28 engage the foot beam flanges adjacent to the location where the distal ends of the splice angle brackets 14 are secured to the foot beams 12.

Figure 13:
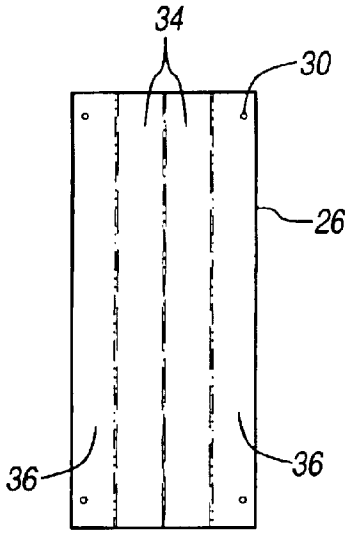
FIG. 13 is a plan view of a toe beam in blank form.
Figure 14:
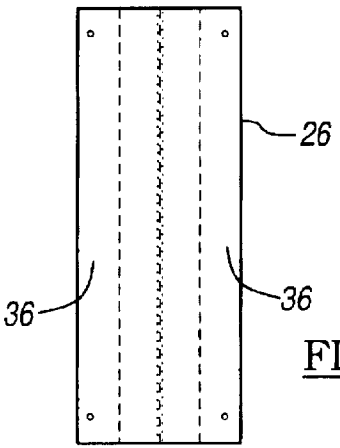
FIG. 14 is a plan view of a formed toe beam.
Figure 15:
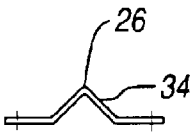
FIG. 15 is an end view of the toe beam shown in FIG. 14.

Another element interconnecting the buttress post assemblies 10 are the toe beams 26. FIGS. 13, 14 and 15 show the toe beam in its blank and formed configurations. As shown, the blank is drilled at 30 for the reception of fastening means and, when the blank is crimped into its desired form, shown in view in FIG. 15, it includes an elongated, central inverted V-shaped beam 34, throughout its length and is flanked by side flanges 36.

As shown in FIG. 9, a toe beam 26 is located between juxtaposed sides of buttress assemblies 10 at the distal ends thereof which eventually lie beneath the finished pool. Thus, each toe beam 26 is secured to a flange 6 of a foot beam 12 by means of suitable fasteners such as self-tapping screws 31. It will be understood from FIG. 9 that the toe beams 26 serve to space the foot beams 12 one from another at their distal ends and to provide some vertical stability to those beams at the inner ends thereof.

The tension straps 24 extend between and are secured to the upper surfaces 3 of the foot beams 12 at their inner or distal ends. These straps extend between the inner end of the foot beam 12 on one side of the pool to the same element on the foot beam on the opposite side of the pool. If more than one tension strap is required between foot beams, they would both be fastened together with suitable securing means such as machine screws.

Figure 24:
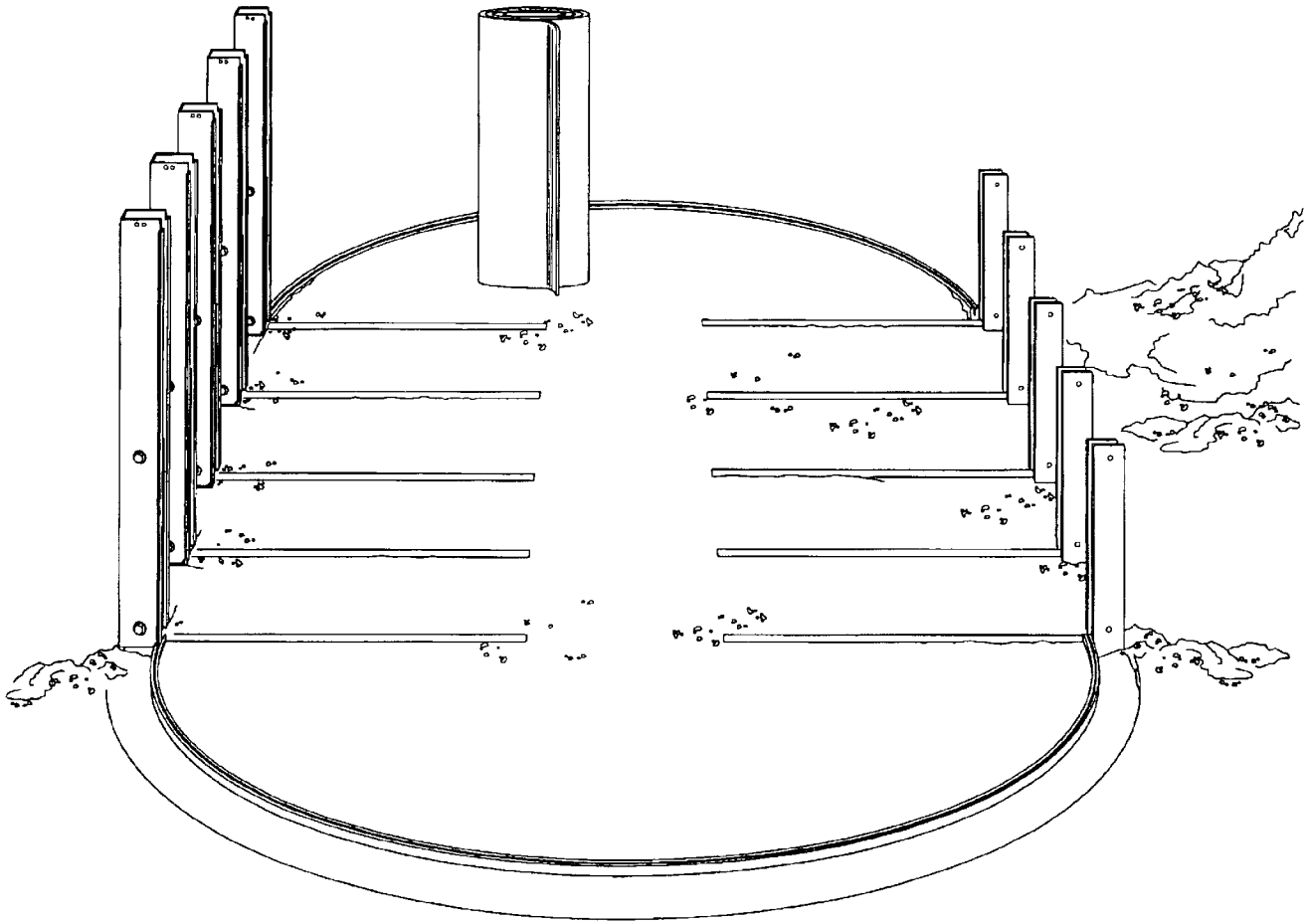

As illustrated in FIGS. 21A through 21E inclusive, the tension straps 24 are manufactured so that they are available in a variety of lengths to suit pools of varying widths. FIG. 7, which shows a buttress post assembly located in an excavated channel in the ground, would have the tension strap 24 being located at or slightly above ground level. FIG. 24 gives a good illustration of this. It will also be appreciated that the surface area of the tension straps and the associated foot beams 12 are subject to the full weight of the contents of the pool and, through the connections of the foot beams to the buttress posts 22, ensures that those posts are maintained in the desired orientation, notwithstanding the pressure on the pool walls against them.

Figure 5:
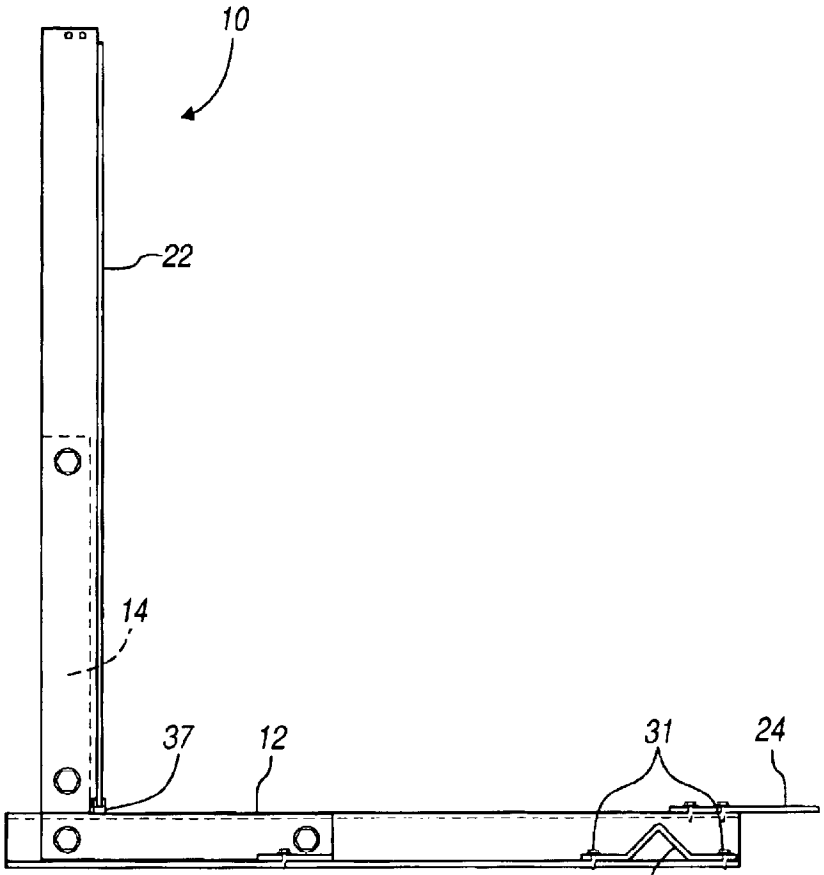
FIG. 5 is a side elevation of the buttress assembly of FIG. 4.
Figure 4:
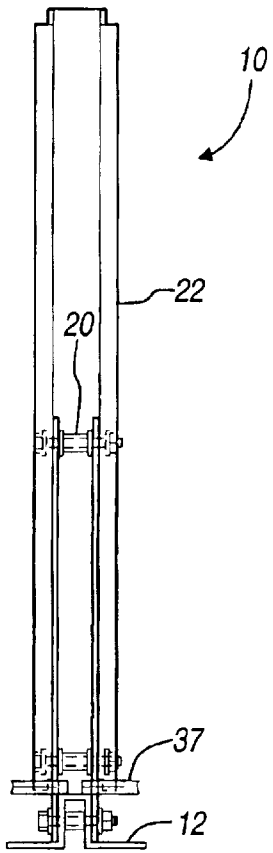
FIG. 4 is an end elevation of a buttress assembly.

FIGS. 4, 5 and 8 illustrate the location of the bottom track 37 which is in the form of an open-topped rail that extends between the foot of the buttress posts on the inside thereof and its ends rest on the upper surface of the foot beams 12. This track is used for supporting the lower end of outer pool wall panelling.

Figure 23:
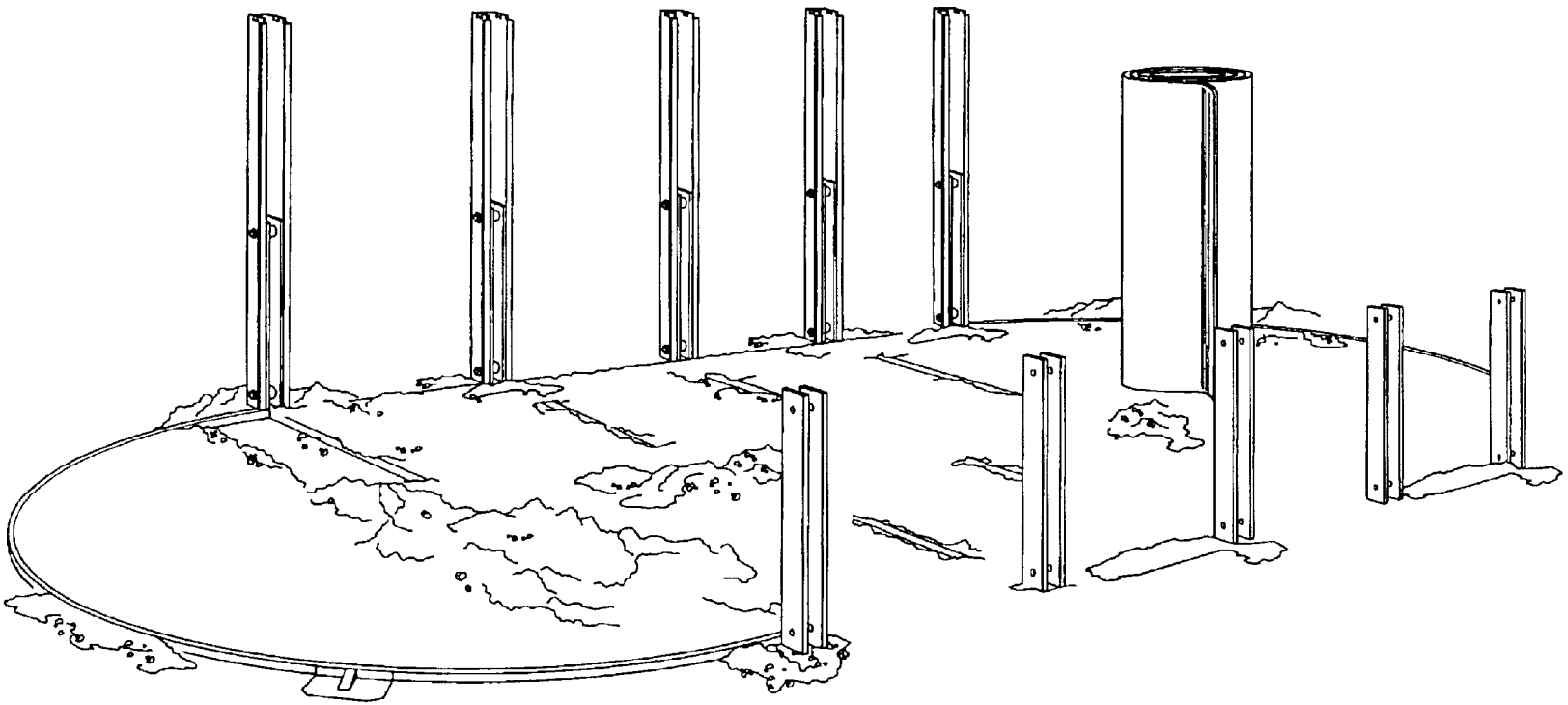
FIGS. 23 and 24 are perspective views of a partially erected test structure.

FIGS. 23 and 24 are perspective views of a partially erected pool structure for testing purposes. In the foreground of FIG. 23 and on the right side of FIG. 24, the spaced, upper legs 15 of the splice angle brackets 14 are clearly shown while, in the background of FIG. 23 and the left side of FIG. 24, more complete series of buttress post assemblies 22 are shown with the posts 22 being secured to the splice angle brackets 14.

The top surfaces of the foot beams 12 are visible at ground level in FIG. 24.

Figure 25:
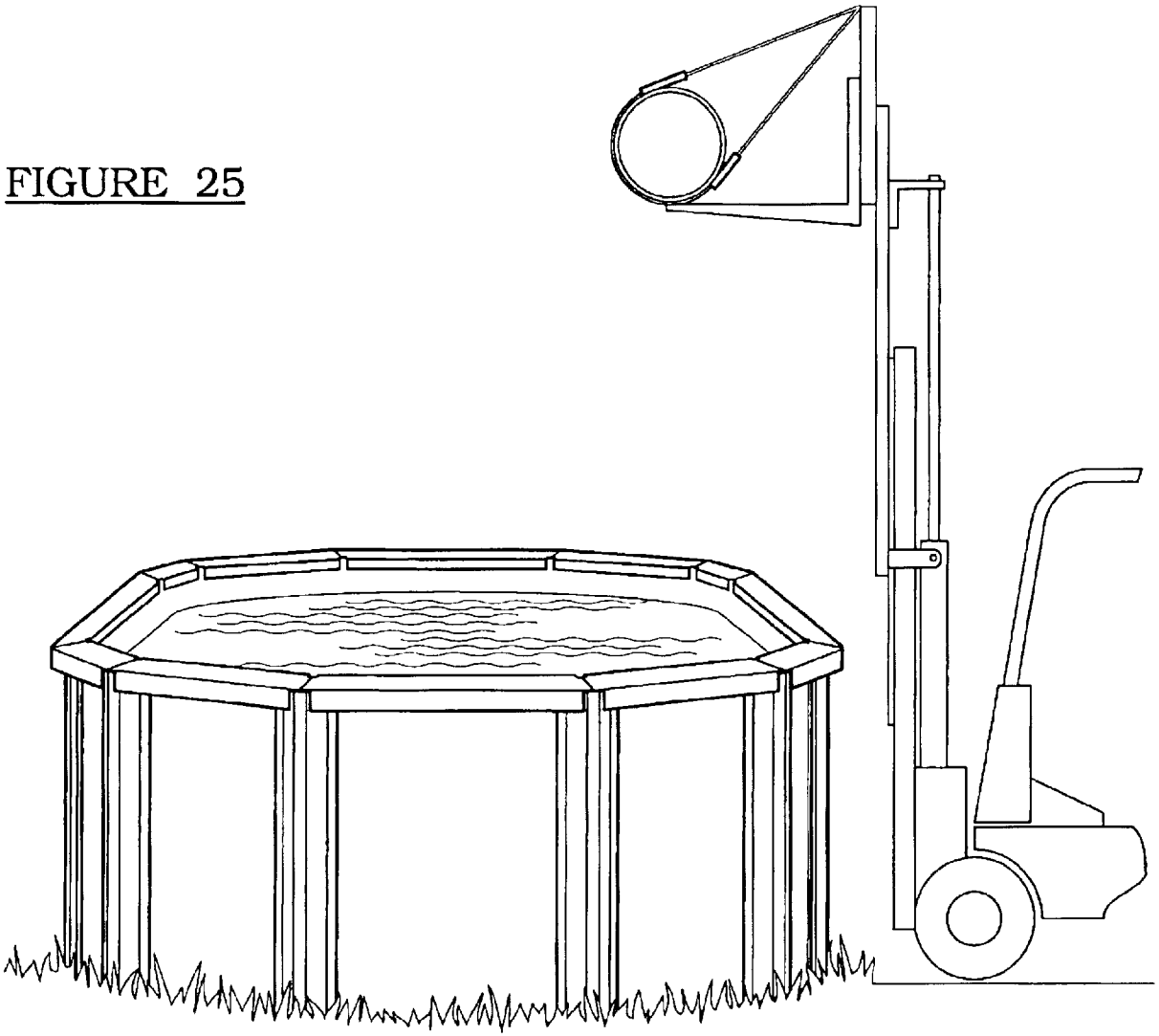
FIGS. 25, 26 and 27 illustrate three phases of a testing procedure on a test pool incorporating the present invention.
Figure 26:
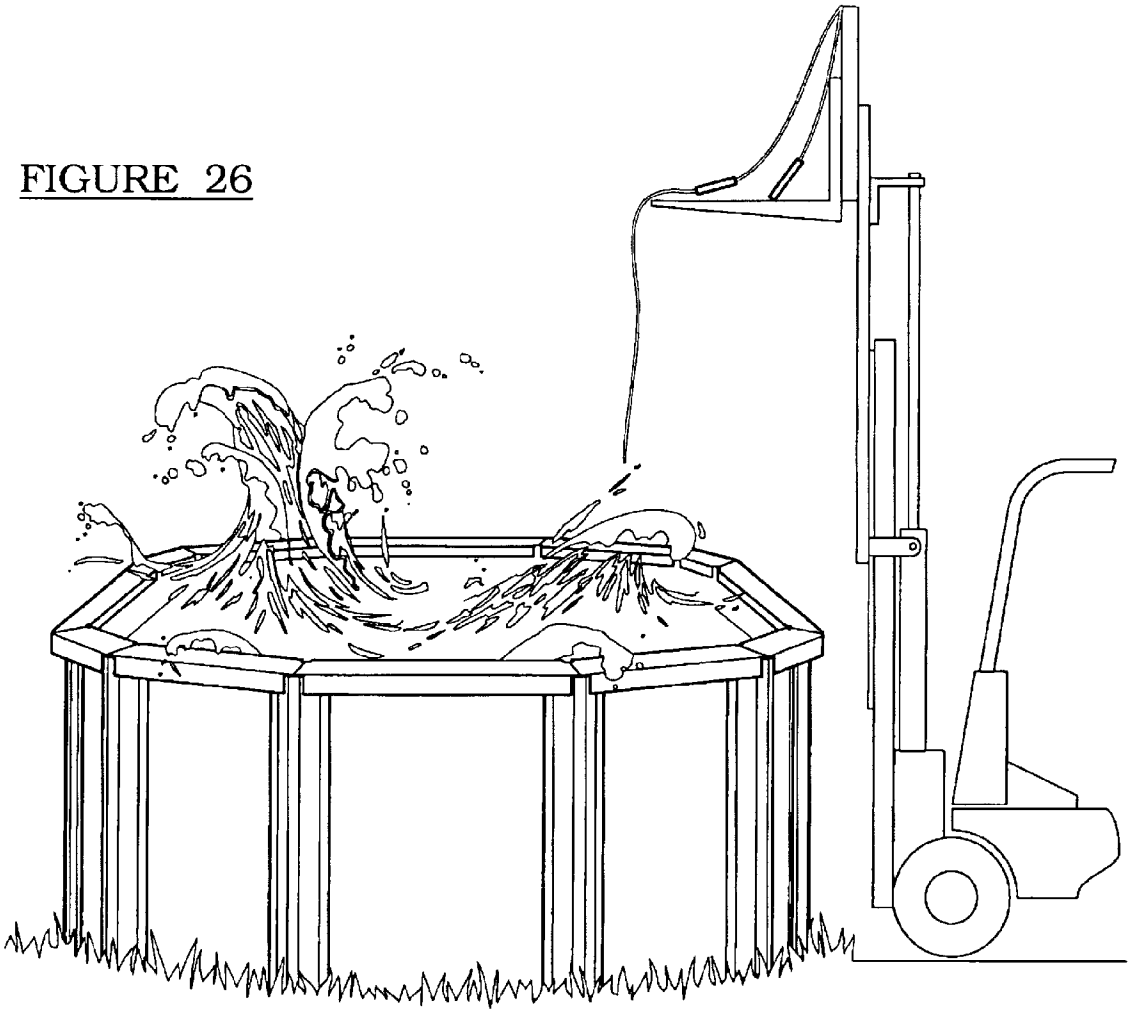
Figure 27:
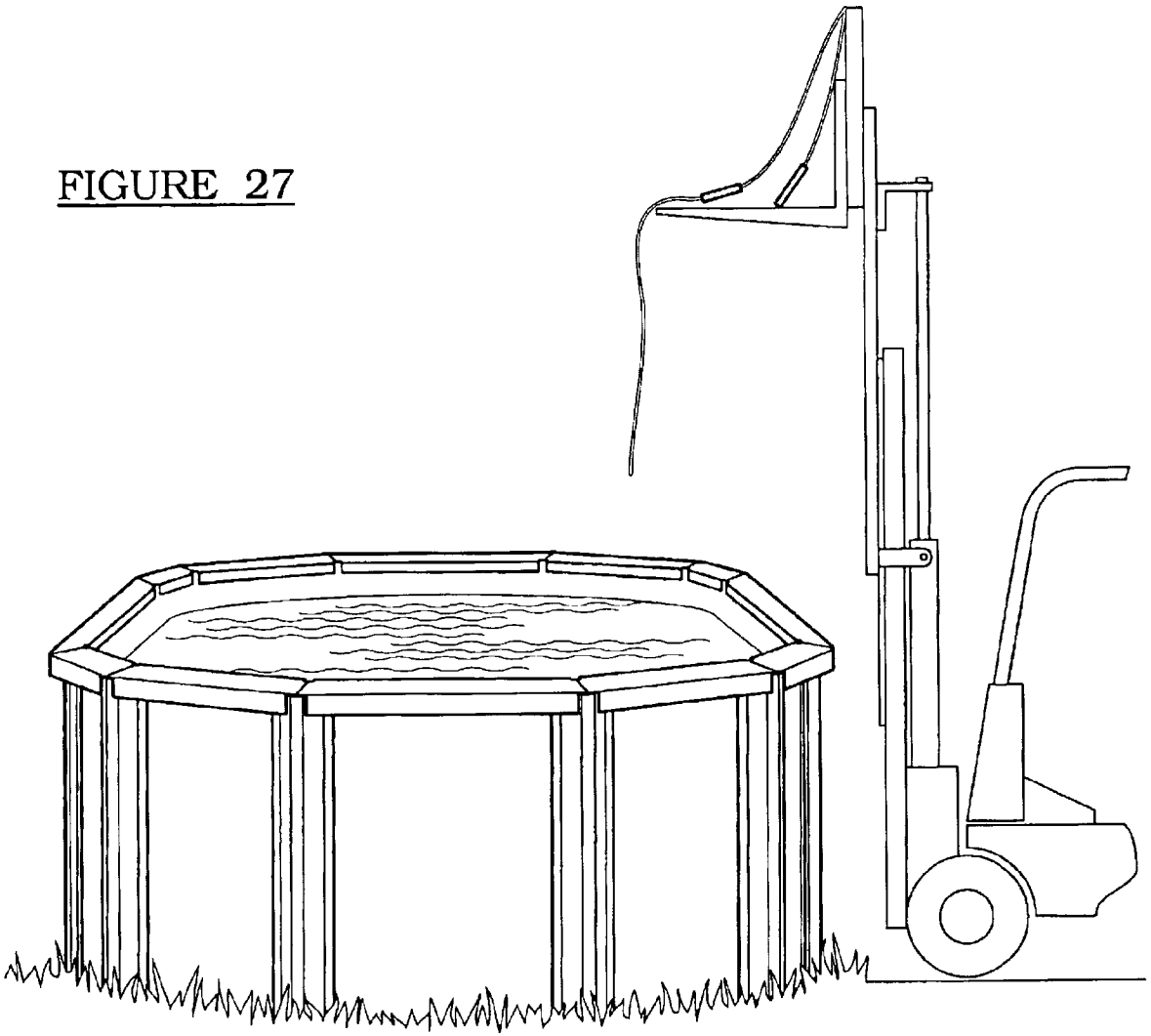

FIGS. 25, 26 and 27 is a sequence of three illustrations relative to a pressure test for an erected pool.

FIG. 25 shows a weighted drum 40 being suspended at a substantial height from a test pool 42 which has been filled with water. In FIG. 26, the weighted drum has been released and dropped into the pool thereby subjecting the walls of the pool to an instantaneous, sharp increase in internal pressure. However, as illustrated in FIG. 26 and in FIG. 27, notwithstanding the increase pressure, the walls of the pool remain unaffected.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications The embodiments of the invention in which an exclusive property or privilege is claimed are defined as follows:

1. A buttress support structure for a swimming pool wall comprising a plurality of buttress assemblies spaced about the periphery of the pool, said buttress assemblies being laterally connected one to another in side-by-side relation and each buttress assembly being linearly connected to another buttress assembly directly across the pool therefrom; each said buttress assembly including a (a) foot beam extending inwardly of the pool beneath the floor thereof, said foot beam having an inverted U-shaoed channel member having toD and side surfaces and flanaes extending outwardly of the sidewalls at the lower edaes thereof, (b) a vertical buttress post on the outside of the pool wall and (c) brackets connecting said buttress post to said foot beam.

2. The buttress support structure according to claim 1 wherein said brackets comprise a pair of splice angle brackets, with one leg of each bracket being secured to opposite sidewalls of said foot beam and the other legs thereof providing vertical support means for said buttress post.

3. The buttress support structure according to claim 2 wherein said buttress post comprises a U-shaped channel member having its sidewalls secured to the vertical legs of the splice angle brackets.

4. The buttress support structure according to claim 1 including a support plate extending laterally between and secured to the flanges of said foot beams and located generally centrally of the length of said foot beams.

5. The buttress support structure according to claim 1 including a toe beam extending laterally between the inner, distal ends of each pair of said foot beams, said toe beam having a pair of flanges and an inverted V-shaped channel extending centrally of its length, said flanges being secured to the flanges of the foot beams of said buttress assemblies.

6. A composite support assembly for use in supporting the wall of a swimming pool, said assembly comprising a base member adapted to lay horizontally beneath the floor of the pool, an upright post member to be located on the outside of the pool wall, and means interconnecting the post and base members;

said interconnecting means comprising a pair of spaced, generally L-shaped angle brackets having a first pair of legs secured to each base member, one on either side thereof and with their other, second pair of legs extending vertically at right angles therefrom, and said upright post members being secured to said second pair of legs.

7. A composite support assembly according to claim 6 wherein said base member comprises an inverted U-shaped channel having spaced sidewalls and flanges extending normal thereof; and said post member comprises a U-shaped channel having spaced sidewalls which enclose and are secured to said second pair of vertically extending legs of said angle brackets.

8. A composite support assembly according to claim 7 including means for securing the base member, brackets and post member together comprising bolt assemblies incorporating spool spacer sleeves located intermediate the spaced legs of said brackets and the spaced sidewalls of said base and post channels.

* * * * *

UNITED STATES PATENT AND TRADEMARK OFFICE

CERTIFICATE OF CORRECTION

PATENT NO. : 6,795,985 B2
DATED : September 28, 2004
INVENTOR(S) : George M. Mathias It is certified that error appears in the above-identified patent and that said Letters Patent is hereby corrected as shown below:

Column 2,
Line 60, “a-foot” should be -- a foot --;

Column 3,
Line 22, after “therefrom” insert --. --;

Column 7,
Line 22, after “modifications” insert -- are possible within the scope of the invention claims --;
Line 33, “U-shaoed” should be -- U-shaped --;

Signed and Sealed this

Fourteenth Day of December, 2004

JON W. DUDAS
*Director of the United States Patent and Trademark Office*